United States Patent [19]

Ida et al.

[11] Patent Number: 4,992,154

[45] Date of Patent: Feb. 12, 1991

[54] BRUSH FOR ELECTROLYTIC TREATMENT

[75] Inventors: Yoshiaki Ida; Keigo Obata, both of Hyogo, Japan

[73] Assignee: Marui Mekki Kogyo Yugen Kaisha, Hyogo, Japan

[21] Appl. No.: 395,842

[22] Filed: Aug. 18, 1989

[30] Foreign Application Priority Data

Aug. 19, 1988 [JP] Japan ..... 63-109387[U]
Nov. 21, 1988 [JP] Japan ..... 63-151565[U]

[51] Int. Cl.[5] ..... C25D 17/14; C25D 17/12

[52] U.S. Cl. ..... 204/224 R; 204/224 M; 204/271

[58] Field of Search ..... 204/224 R, 271, 224 M

[56] References Cited

U.S. PATENT DOCUMENTS 2,498,129 2/1950 Lindsay ..... 204/224 R
2,961,395 11/1960 Icxi ..... 204/224 R
3,326,793 6/1967 Lennon ..... 204/224 R
3,346,477 10/1967 Wolfer ..... 204/224 R
3,520,792 7/1970 Kerschgens ..... 204/271 X
3,637,468 1/1972 Icxi et al. ..... 204/271 X
3,779,887 12/1973 Gildone ..... 204/271 X
4,159,934 7/1979 Kadija ..... 204/224 R

*Primary Examiner*—Donald R. Valentine
*Attorney, Agent, or Firm*—Lowe, Price, Leblanc, Becker & Shur

[57] ABSTRACT

A brush for use in electrolytic treatment having a brush body including an electrode connected to one terminal of a D.C. source and contacting a workpiece connected to the other terminal of the D.C. source. The brush body comprises a forward portion defining an electrode compartment housing an electrode contact. An electrode holder is removably mounted in the compartment.

6 Claims, 8 Drawing Sheets

BRUSH FOR ELECTROLYTIC TREATMENT

BACKGROUND OF THE INVENTION (1) Field of the Invention

The present invention relates to brushes for use in electrolytic treatment, and more particularly to brushes suited for plating, polishing, etching, anodic oxidation or electrolytic pigmentation.

(2) Description of the Prior Art

Generally, what is known as brush plating which employs a pencil type electrode is used in plating workpieces which cannot be immersed in a plating bath or in plating only part of workpieces.

Further, since the device is in the form of a brush, multi-layer plating can be applied to a workpiece by repeatedly running the brush over its surfaces. Thus, brush plating is applicable also to those workpieces which require plating layers.

The brush used in such technique comprises an electrode fixed to a brush body and connected to the positive terminal of a D.C. source. A workpiece is connected to the negative terminal. An appropriate plating solution is applied to the electrode directly or through a liquid retaining material. In this state, direct current is applied to the electrode which is run lightly over workpiece surfaces. The conventional technique has the following disadvantages.

In carrying out a desired plating treatment, the electrode may be formed of the same material as the plating such that, for example, a copper electrode is used for effecting copper plating and a silver electrode for silver plating. Thus, different brushes with electrodes formed of metals corresponding to the plating metals are made available. It is very expensive to prepare and use the brushes having different types of electrodes.

An insoluble electrode such as of stainless steel or baked carbon may be used, but here again a plating solution corresponding to the electrode must be applied thereto. Even where a plurality of brushes having the same type of electrodes are available for use, the brushes used with a particular type of plating solution cannot be used with a different plating solution without completely removing the earlier solution. This cleaning operation is very troublesome, and therefore many brushes must be made available for exclusive use with respective plating solutions (plating metals).

Where an external D.C. source is used as the power source, many lead wires run from the plurality of brushes across the site of operation, which present obstacles to the operation. If only one lead wire is used for one brush and then for another, the connecting operation will be too troublesome.

SUMMARY OF THE INVENTION

An object of the present invention is to improve the operating efficiency of the plating treatment and allow desired plating to be effected without requiring many brushes for different types of plating solutions.

In order to achieve this object, the present invention provides a brush for use in electrolytic treatment having a brush body including an electrode connected to one terminal of a D.C. source and contacting a workpiece connected to the other terminal of the D.C. source, the brush comprising a forward portion formed on the brush body and defining an electrode compartment, an electrode contact disposed inside the compartment, and an electrode holder removably mounted in the compartment.

According to the present invention, one brush body and a plurality of electrode holders are made available, each holder including an electrode. A plating operation is carried out by changing the electrode holder for each different plating solution in a one-touch operation.

Since the electrode is removably attached to one brush body, the brush of this invention may be used for many types of plating metals in a simple manner. This brush is useful for partial plating in industry and handicraft in household levels.

The plating solution may be contained in a cartridge for supplying the solution to a liquid retaining material with ease.

Other objects, features and advantages of the present invention will be apparent from the following description.

DESCRIPTION OF THE PREFERRED EMBODIMENTS

Figure 1:
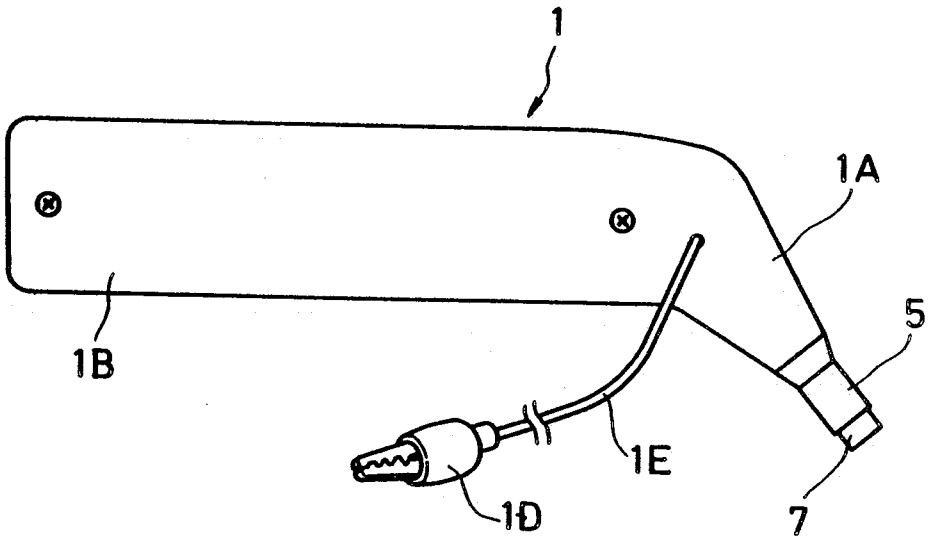
FIG. 1 is a side view of an entire plating brush according to a first embodiment of the present invention.
Figure 2:
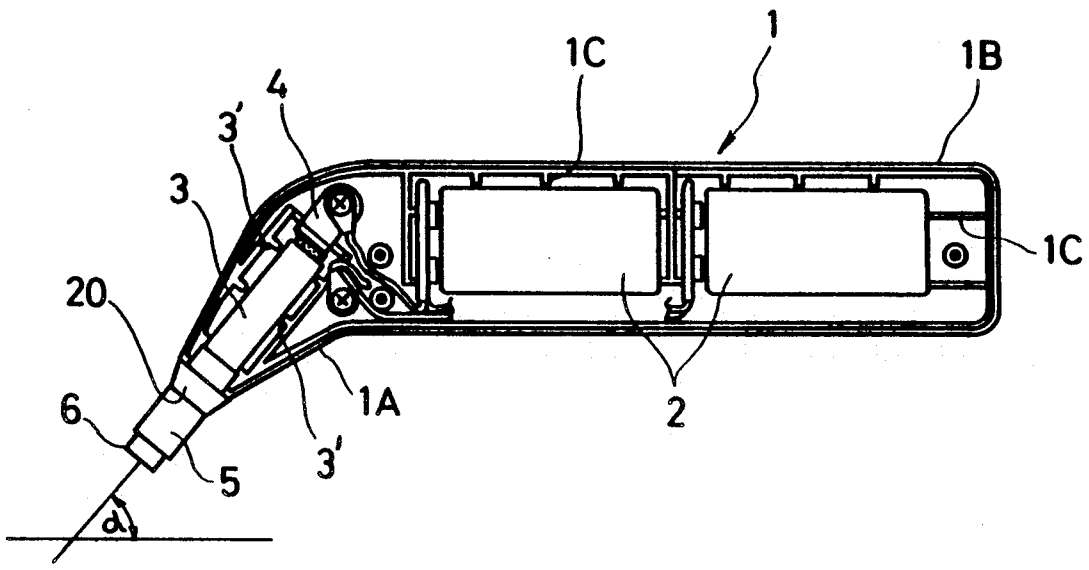
FIG. 2 is a side view in vertical section of the plating brush.

Referring to FIGS. 1 and 2, a plating brush comprises a brush body 1 consisting of two halves formed of a plastic by injection molding. To facilitate a plating operation for a workpiece (not shown), the brush body 1 includes a forward portion 1A bent such that the axis of a carbon electrode 6 extends at an angle $\alpha$ of 40 to 60 degrees to the axis of a main or rear portion 1B of the brush body 1.

The rear portion 1B defines a battery holder 1C for accommodating batteries 2 acting as a D.C. source. The forward portion 1A defines an electrode compartment 3 housing a plate-shaped electrode contact 4 and defining a plurality of ribs 3' projecting inwardly.

The electrode contact 4 is connected through a lead wire to positive terminals of the batteries 2 mounted in the battery holder C. Negative terminals of the batteries 2 are taken out by a lead wire 1E connected to a clip 1D. The clip 1D holds the workpiece which acts as a cathode during a plating operation (see FIG. 9).

Figure 3:
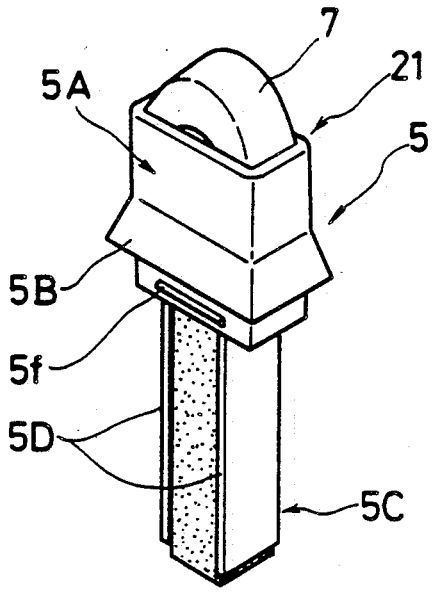
FIG. 3 is a perspective view of an electrode holder.
Figure 4:
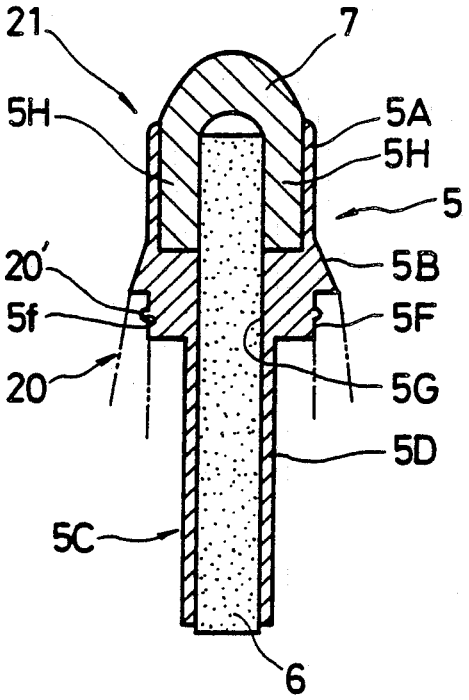
FIG. 4 is a side view in vertical section of the electrode holder.

As shown in FIGS. 3 and 4, an electrode holder 5 is also formed by plastic molding, separately from the brush body 1. The electrode holder 3 is removably mounted in the compartment 3 of the brush body 1. This electrode holder 3 has a forward portion 5A defining a rectangular vessel 21, and an engaging portion 5F at a rear end thereof for fitting into a holder receiving opening 20 defined in the forward portion 1A of the brush body 1. The electrode holder 3 further includes a flange 5B for limiting an inserting depth in the holder receiving opening. A perforation 5G is formed in the bottom of the vessel 21 for receiving the electrode 6, and two parallel sandwiching plates 5D extend rearwardly from the perforation 5G. Thus, the electrode 6 extends through the perforation 5G, sandwiched at a base portion 5C between the plates 5D and projecting into the vessel 21 at the forward portion 5A. With the electrode 6 mounted in position, the vessel 21 defines felt receiving spaces 5H at opposite sides across the electrode 6 in the right and left direction in FIG. 4. Opposite ends of a felt 7 in an inverted V-shape are inserted into these spaces 5H.

The electrode holder 5 as constructed above is attached to the brush body 1, with the engaging portion 5F fitted in the holder receiving opening 20 of the brush body 1. The engaging portion 5F defines a ridge 5f which engages a recess 20' formed in a forward end wall of the holder receiving opening 20 for securing the electrode holder 5 to the brush body 1. In this position, the rear end of the electrode 6 abuts on the electrode contact 4.

Figure 6:
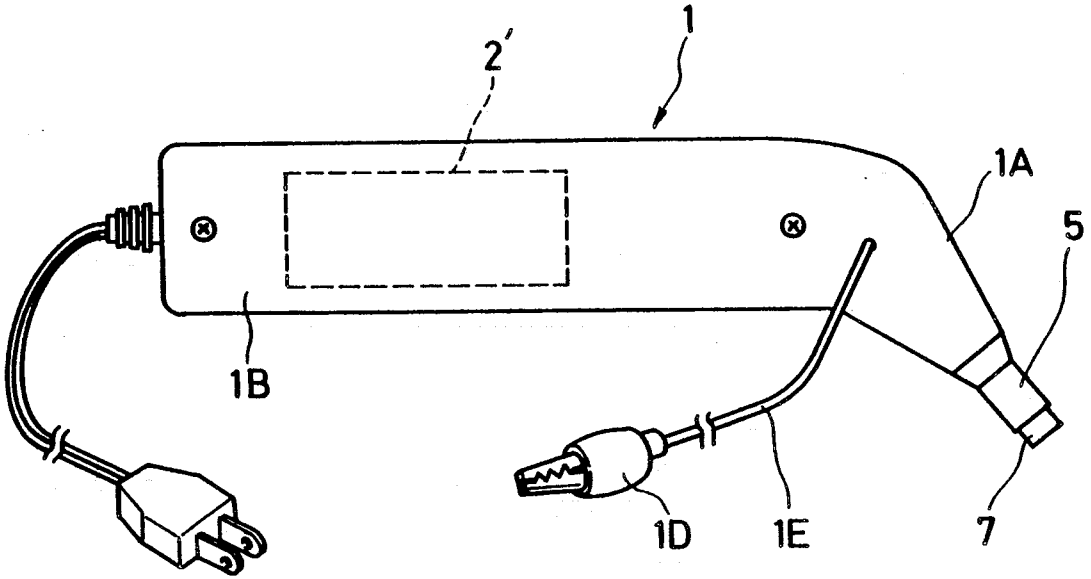
FIG. 6 is a side view of an entire plating brush containing a rectifier according to another embodiment.

As shown in FIG. 6, the brush body 1 may of course contain a transformer and rectifier 2' instead of the batteries 2 acting as the D.C. source. In this case, the brush body 1 is connected directly to an external power source through a lead wire. The transformer and rectifier 2' may be disposed outwardly of the brush body 1 as an adapter for connection to an external power source.

The bending angle $\alpha$ of the forward portion 1A of the brush body 1 preferably is 40 to 60 degrees.

In the described embodiment, the electrode 6 comprises a carbon electrode. However, the electrode may comprise copper, silver, stainless steel or other material suited for the purpose. The electrode may have a circular section instead of being square.

The felt is used as a liquid-retaining material in the foregoing embodiment, but any other conventional material may be used as long as a plating solution is retained.

Further, in the foregoing embodiment, the plating solution is directly supplied through a spuit. However, the solution may be supplied by other means as described later.

Figure 9:
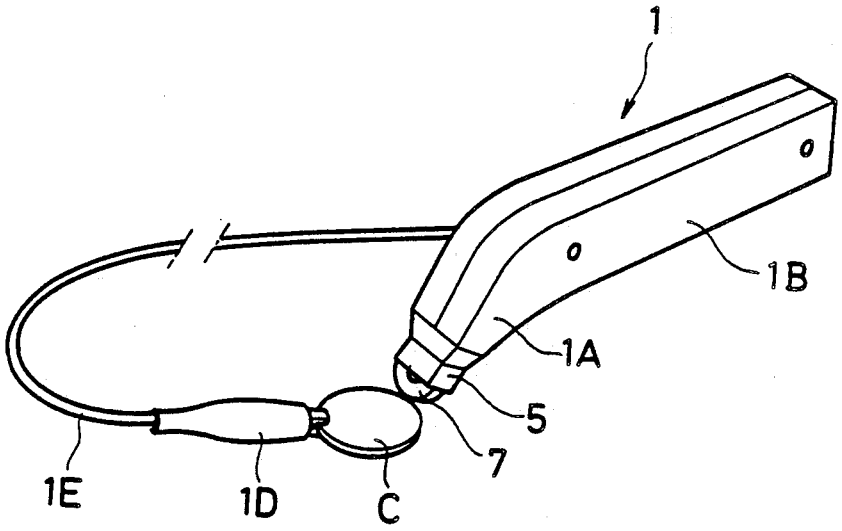
FIG. 9 is a perspective view showing the plating brush according to the first embodiment as used.

FIG. 9 shows how the brush for electrolytic treatment as constructed above is used for plating a coin. The coin is held by the clip 1D, and the felt 7 is impregnated by a spuit or the like with a plating solution corresponding to an intended metal. Then the felt 7 is run lightly over the coin surfaces. Other objects such as necktie pins, belt buckles and handbag frames may be plated as desired with ease.

Figure 5:
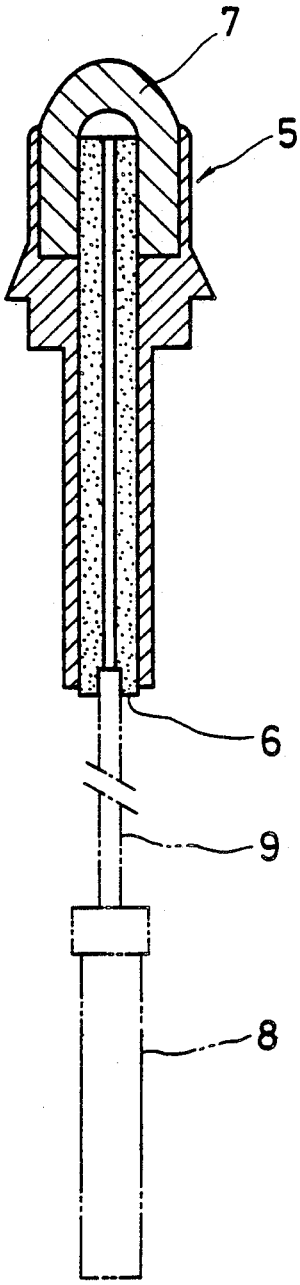
FIG. 5 is a side view in vertical section of a different electrode holder.

FIG. 5 shows another embodiment of this invention. The plating solution is contained in a cartridge mounted in the brush body 1. The solution is automatically supplied to the felt 7 through a conduit 9 extending through a bore defined in the electrode 6.

The electrode holder 5 may define a passage in a portion thereof, instead of the conduit 9 being provided by the bore defined in the electrode 6.

Figure 7:
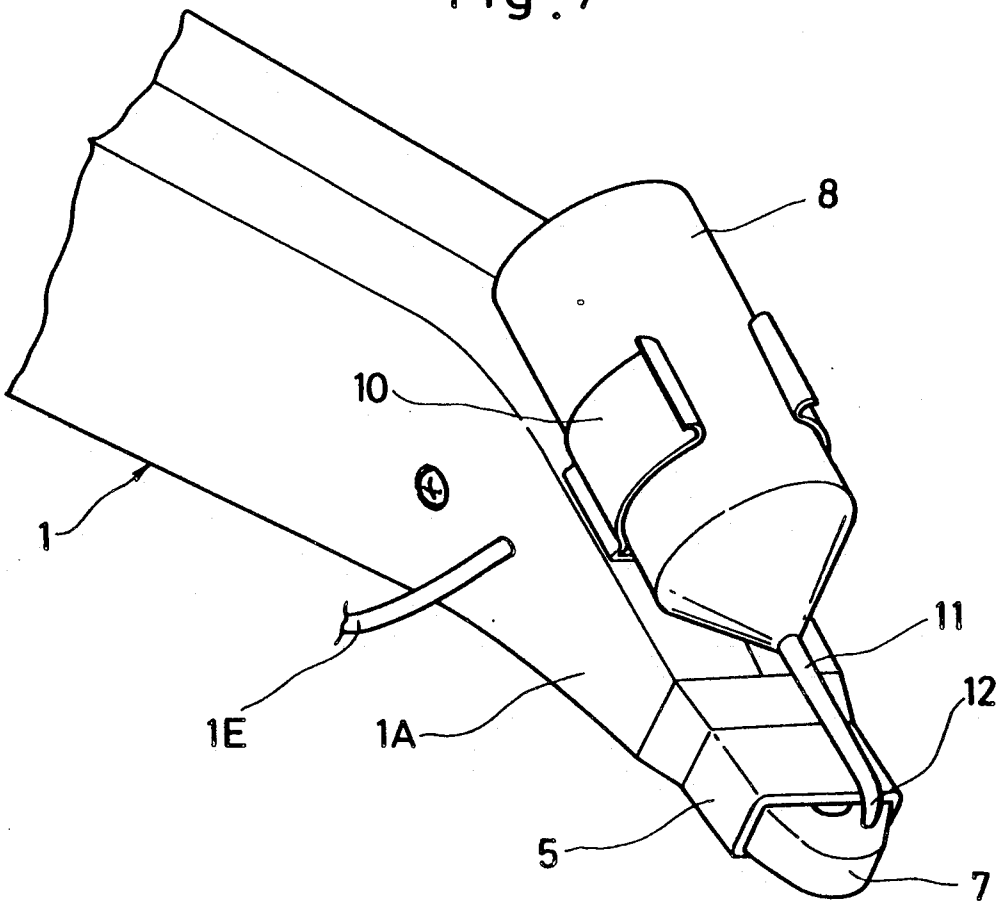
FIG. 7 is a perspective view of an entire plating brush carrying a spuit according to a further embodiment.

As shown in FIG. 7, the brush body 1 may include an elastic holder 10 on top of the forward portion thereof for removably holding a cartridge 8 defining a spuit 11 extending forwardly to a position adjacent the felt 7. Then the plating solution may be supplied from the cartridge 8 with ease.

Figure 8:
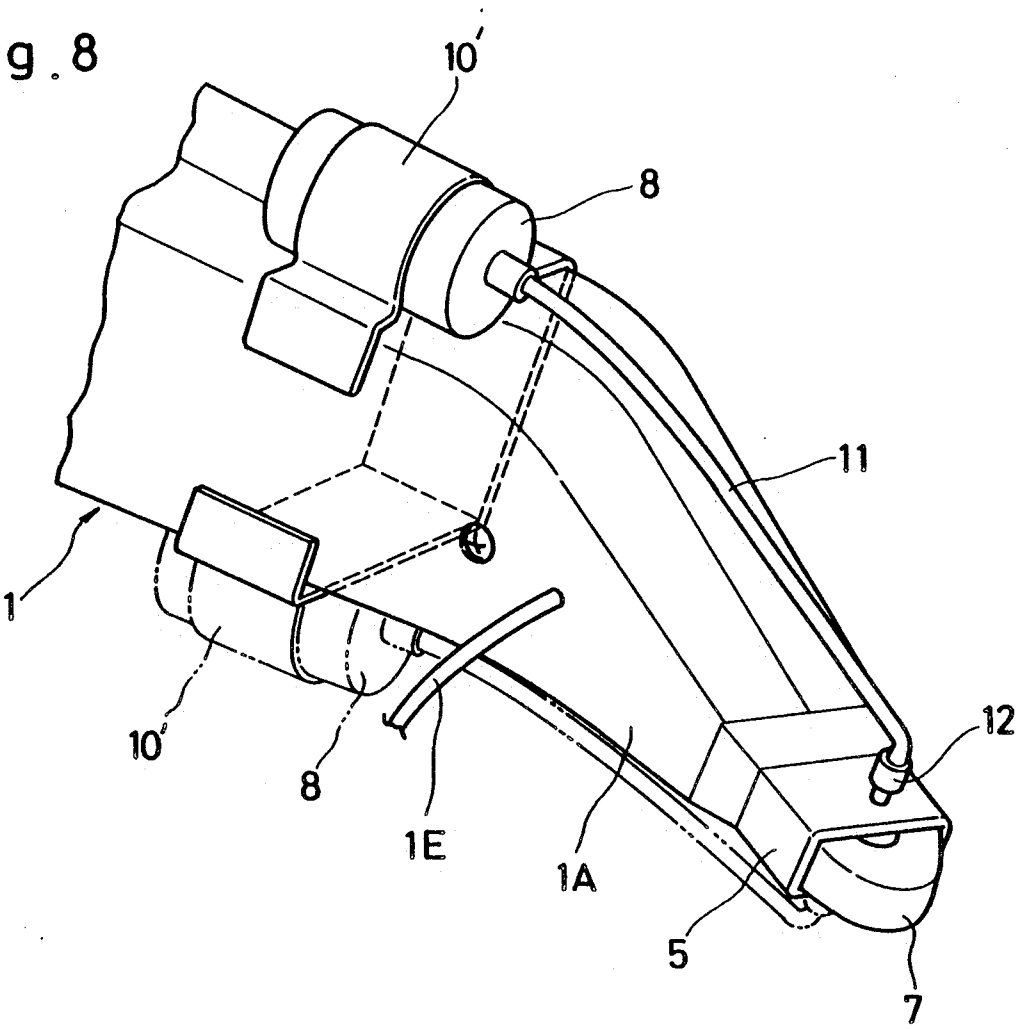
FIG. 8 is a perspective view of an entire plating brush carrying a spuit mounted thereon to be vertically movably according to a still further embodiment.

Further, as shown in FIG. 8, the brush body 1 may carry an approximately C-shaped holder 10' mounted on top or bottom of the brush body 1. This construction is convenient in that the spuit 11 may be placed to extend along an upper surface or a bottom surface of the brush body 1.

It is to be noted that the electrode 6 acts as an anode during a plating operation, and as a cathode during a polishing or anodic oxidation treatment.

Where the electrode 6 comprises a carbon fiber molding, it is highly insoluble compared with a stainless steel electrode, and much less brittle than a carbon burned product. Thus the electrode comprising a carbon fiber molding has the advantage that its forward end and intermediate portion are less vulnerable to damage.

What is claimed is:

1. A brush for use in electrolytic treatment having a brush body including an electrode connected to one terminal of a D.C. source and contacting a workpiece connected to the other terminal of the D.C. source, said brush comprising a forward portion formed on the brush body and defining an electrode compartment, an electrode contact disposed inside said compartment, and an electrode holder removably mounted in said compartment, wherein said electrode holder includes a forward portion defining a vessel, and a rear portion defining an engaging portion for fitting into a holder receiving opening defined in said forward portion of said brush body, said vessel having a bottom thereof defining a bore for receiving said electrode extending into said vessel, and felt receiving spaces being defined in said vessel at opposite sides across said electrode for receiving opposite ends of a felt, respectively, and said brush body houses a cartridge containing a plating solution, for automatically supplying the plating solution by way of a conduit extending through said electrode to a liquid retaining material attached to a forward end of said brush body.

2. A brush for use in electrolytic treatment having a brush body including an electrode connected to one terminal of a D.C. source and contacting a workpiece connected to the other terminal of the D.C. source, said brush comprising a forward portion formed on the brush body and defining an electrode compartment, an electrode contact disposed inside said compartment, and an electrode holder removably mounted in said compartment, wherein said electrode holder includes a forward portion defining a vessel, and a rear portion defining an engaging portion for fitting into a holder receiving opening defined in said forward portion of said brush body, said vessel having a bottom thereof defining a bore for receiving said electrode extending into said vessel, and felt receiving spaces being defined in said vessel at opposite sides across said electrode for receiving opposite ends of a felt, respectively, and said brush body carries a cartridge removably mounted thereon and containing a plating solution, said cartridge including a spuit extending from a forward end thereof and opening at a position adjacent a forward end of said electrode.

3. A brush for use in electrolytic treatment operations, said brush comprising: a brush body including an electrode compartment; an electrode contact provided in said electrode compartment; and an electrode holder removable mounted in said electrode compartment via a holder receiving opening defined in said brush body, said electrode holder including a forward portion defining a vessel that includes a bottom having a perforation formed therein, two parallel sandwiching plates extending rearwardly from said perforation, and an engaging portion at a rear end of said electrode holder adapted to fit in said holder receiving opening; an electrode located between said sandwiching plates and extending through said perforation into said vessel, wherein said electrode and said vessel define liquid-retaining material receiving spaces; and a liquid-retaining material having opposite ends thereof inserted in said liquid-retaining material receiving spaces.

4. A brush for use in electrolytic treatment operations as claimed in claim 3, wherein said electrode holder further includes a flange that limits the depth of insertion of said electrode holder into said holder receiving opening.

5. A brush for use in electrolytic treatment operations as claimed in claim 3, wherein said electrode abuts said electrode contact when said electrode holder is mounted in said electrode compartment.

6. A brush for use in electrolytic treatment operations as claimed in claim 3, wherein a conduit extends through the length of said electrode.

* * * * *